US009463497B2

(12) United States Patent
Cernuschi et al.

(10) Patent No.: US 9,463,497 B2
(45) Date of Patent: Oct. 11, 2016

(54) CONTROL SYSTEM FOR HYDRAULIC ROLLING MILL CAPSULES FOR ROD-LIKE BODIES

(75) Inventors: Ettore Cernuschi, Castelletto Sopra Ticino (IT); Simone Piacentini, Lodi (IT)

(73) Assignee: Danieli & C. Officine Meccaniche S.P.A., Buttrio (IT)

( * ) Notice: Subject to any disclaimer, the term of this patent is extended or adjusted under 35 U.S.C. 154(b) by 315 days.

(21) Appl. No.: 13/490,800

(22) Filed: Jun. 7, 2012

(65) Prior Publication Data

US 2013/0306772 A1 Nov. 21, 2013

(30) Foreign Application Priority Data

May 15, 2012 (IT) ..... MI2012A0840

(51) Int. Cl.
*B21B 13/10* (2006.01)
*B21B 31/10* (2006.01)

(52) U.S. Cl.
CPC ..... *B21B 13/10* (2013.01); *B21B 31/10* (2013.01)

(58) Field of Classification Search
CPC .. A01F 29/005; A01F 29/095; A47J 43/255; A47J 42/40; A23G 1/10; A23G 1/0215; A23G 3/0215; B02C 18/20; B02C 18/0007; B02C 18/0046; B02C 18/0015; B02C 13/282; B02C 13/2804; B02C 13/14; B02C 13/28; B02C 13/06; B02C 13/095; B02C 13/04; B02C 13/26; B02C 17/14; B02C 17/16; B02C 17/005; B02C 15/007; B02C 15/12; B02C 15/08; B02C 15/00; B02C 15/04; B02C 15/14; B02C 1/00; A61C 5/068; B01F 7/0005; B01F 7/00991; F25C 5/046; C13B 5/08; B21B 13/10; B21B 31/10
USPC ..... 241/277, 188.1, 189.1, 170, 103, 107, 241/100, 117, 119, 121; 72/224, 234
See application file for complete search history.

(56) References Cited

U.S. PATENT DOCUMENTS

| | | | | |
|---|---|---|---|---|
| 4,002,299 A * | 1/1977 | Skalka | ..... | 241/37 |
| 6,116,071 A | 9/2000 | Cernuschi et al. | | |
| 6,269,733 B1 * | 8/2001 | Reust | ..... | 91/415 |
| 8,800,339 B2 * | 8/2014 | Marin et al. | ..... | 72/235 |

FOREIGN PATENT DOCUMENTS

| | | |
|---|---|---|
| CN | 103406353 A * | 9/2013 |
| DE | 1402649 | 11/1969 |
| DE | 2952098 A * | 7/1981 |
| DE | 69710736 | 10/2002 |

(Continued)

OTHER PUBLICATIONS

Search report and written opinion for PCT/IB2011/051222.

*Primary Examiner* — Mark Rosenbaum
(74) *Attorney, Agent, or Firm* — Stetina Brunda Garred & Brucker

(57) ABSTRACT

In order to facilitate side extraction of the roller holder cartridge (3) in a rolling mill stand (100), the strokes of the hydraulic capsules needed to take the pistons of the same clear from the trajectory traveled by the roller holder cartridge (3) during the extraction of the same from the rolling mill, may reach values indicatively between 150 and 400 mm, values which can negatively affect response times of the position control system of said capsules (4"). In order to continue to apply the same capsule control methods but with a considerably more dynamic system capable of rapidly and accurately reacting to sudden changes of pressure, the servo valves in the control circuits are of the four-way type, instead of the three-way type.

3 Claims, 6 Drawing Sheets

(56) References Cited

FOREIGN PATENT DOCUMENTS

| | | | | |
|---|---|---|---|---|
| IT | WO 2011132094 | | | 10/2011 |
| JP | 56050702 | | | 5/1981 |
| JP | 06122010 | A | * | 5/1994 |
| WO | WO 2011132094 | A2 | * | 10/2011 |

* cited by examiner

CONTROL SYSTEM FOR HYDRAULIC ROLLING MILL CAPSULES FOR ROD-LIKE BODIES

CROSS-REFERENCE TO RELATED APPLICATIONS

Not Applicable

STATEMENT RE: FEDERALLY SPONSORED RESEARCH/DEVELOPMENT

Not Applicable

BACKGROUND

The present invention relates to a hydraulic capsule control system during the rolling cycle of tubes, bars, and rod-like bodies in general, in rolling systems.

State of the Art

Rolling mills for the longitudinal rolling of tubes, and rod-like bodies in general, comprise groups of rolling stands with 2, 3 or more rollers per stand. The rollers of each stand are held together by a cartridge, which makes fitting and removing the rollers easier. In the known rolling mills, the working cartridges are changed in direction either parallel to the rolling axis or transversal thereto. In the latter case, the cartridges are thus changed laterally with respect to the rolling stands, and specifically, in systems in which the hydraulic capsules for regulating and controlling the rolling pressure are rigidly fixed to the outer frame of the stand, capsule piston stroke lengths are provided so as to make the pistons of the capsules retract outside the clearance constituted by the trajectory traveled by the roller holder cartridge during the side extraction of the same from the rolling mill. Such releasing strokes may vary according to the maximum diameter of the tube which can be manufactured by the rolling mill with values indicatively included from 150 to 400 mm, the minimum value being referred to rolling mills for 4"½ tubes, the higher value to rolling mills for 20" tubes. Experience in rolling shows that such values cause problems to the hydraulic capsule position control system during the entire rolling of the tube, but more specifically during the transient steps of leading-in and unloading of the tube from each single stand, when the pressure conditions in the main chamber and in the annular chamber of the hydraulic capsule suddenly change, passing from a discharged condition to a charged condition, and vice versa during unloading. The quality of the regulation of the roller position, and specifically the capacity of the control system to very rapidly correct the movements of the rollers as the loads acting thereon change, greatly depends on the physics of the system governed by the capsule piston stroke. It is known that the physical system becomes more elastic as the capsule stroke increases; the chambers which contain the hydraulic oil being larger, it is consequently more difficult to control oscillations and vibrations of the piston position in the capsule, particularly during transient steps. In the prior art, based on approximately 20 years of use of capsules with stroke shorter than 150 mm, three-way servo valves are used (FIG. 4), the pressure and discharge of which are connected only to port A, being the latter connected to the main chamber of the hydraulic capsule. Port B of the servo valve is closed and the annular chamber is fed by valve systems adapted to attempt to guarantee a pressure as constant as possible in the annular chamber itself. If, as in the case of WO2011/132094, the stroke of the capsule reaches 300 mm or more, up to 400 mm, devices must be evaluated to avoid drastically worsening system functionality with evident repercussions on final product quality consequent to capsule strokes longer than those normally used of 120-160 mm. It is therefore felt the need to make a control system for hydraulic capsules aimed at reducing duration and entity of the error during transient steps and which allows to overcome the aforesaid drawbacks.

BRIEF SUMMARY

It is the object of the present invention to provide a rolling mill stand for rolling rod-like bodies, also of large size, which satisfies the requirement of reducing the time and the entity of the positioning error during transient steps of leading-in and unloading of the tube. Thus, the present invention suggests to reach the above-discussed objects by providing a rolling mill stand defining a rolling axis comprising a fixed outer structure, a roller holder cartridge, three or more working rollers arranged in the roller holder cartridge, the roller holder cartridge being mobile between a working position inside the fixed structure, at said rolling axis, and a side extraction position outside the fixed structure, specifically for changing the working rollers, wherein at least one respective hydraulic capsule is provided for each working roller, the capsule being rigidly fixed to the fixed structure to regulate the radial position of the respective working roller, having a distancing stroke from the rolling axis sufficient to allow the side extraction of said roller holder cartridge, a control system of the three or more working rollers and of the at least one hydraulic capsule, characterized in that the position control system of said at least one hydraulic capsule comprises at least one servo valve of the four-way type.

According to the invention, in the case of capsule strokes longer than 150 mm, but also possibly for shorter strokes, the three-way servo valve is replaced with a four-way type valve. In these servo valves, according to the position controlled by the spool of the servo valve, the pressure and the exhaust are put into communication either with the port connected to the main chamber or with the port connected to the annular chamber. In this manner, during transient steps, the balancing condition which is established between the two chambers of the capsule will be very different from the corresponding condition described for the three-way servo valve.

BRIEF DESCRIPTION OF THE DRAWINGS

Further features and advantages of the invention will be apparent in view of the detailed description of a preferred, but not exclusive, embodiment, of a rolling mill stand illustrated by way of non-limitative example, with, reference to the accompanying drawings, in which.

DETAILED DESCRIPTION

Figure 1:
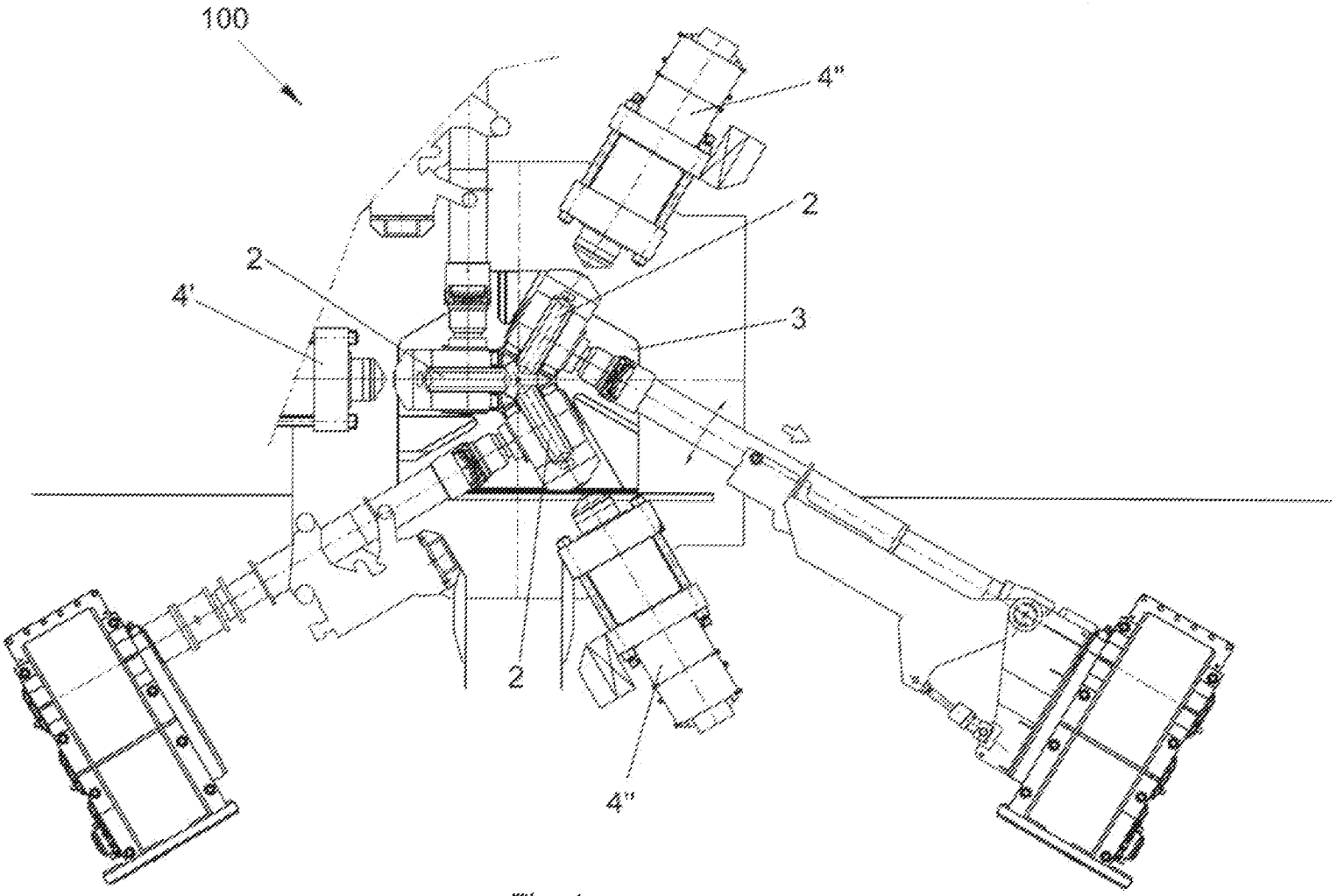
FIG. 1 shows a side view of the rolling mill stand according to the invention.
Figure 3:
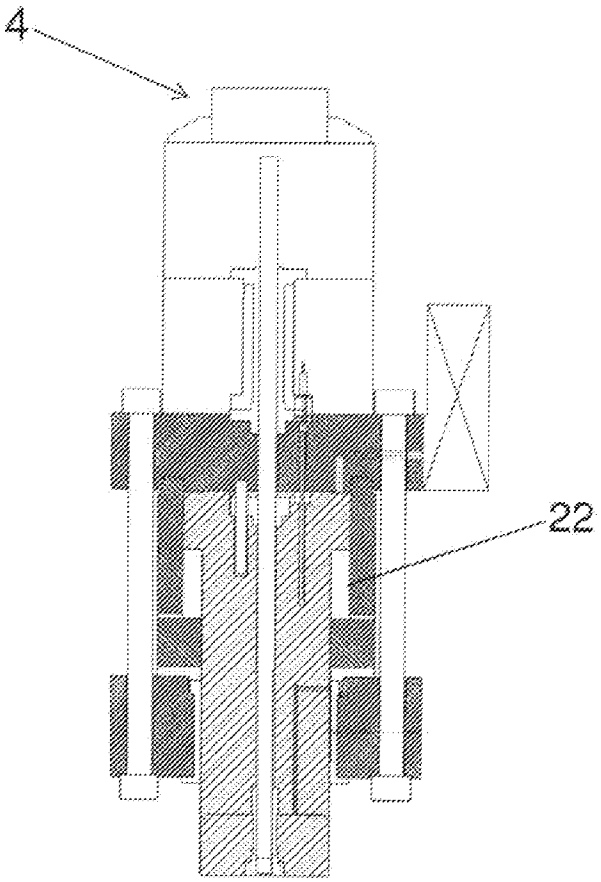
FIG. 3 shows a section view of a hydraulic capsule in FIG. 2, in closed, i.e. contracted, position; this is the position taken by the hydraulic capsule during the roller holder cartridge extraction operations.
Figure 2:
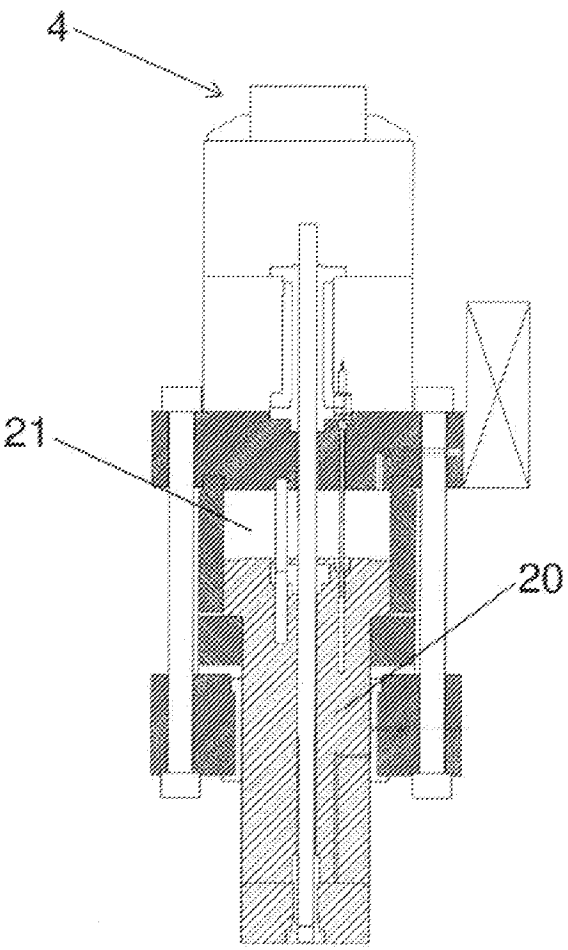
FIG. 2 shows a section view of a hydraulic capsule in all open, i.e. extended, position of the rolling mill stand in FIG. 1.
Figure 4:
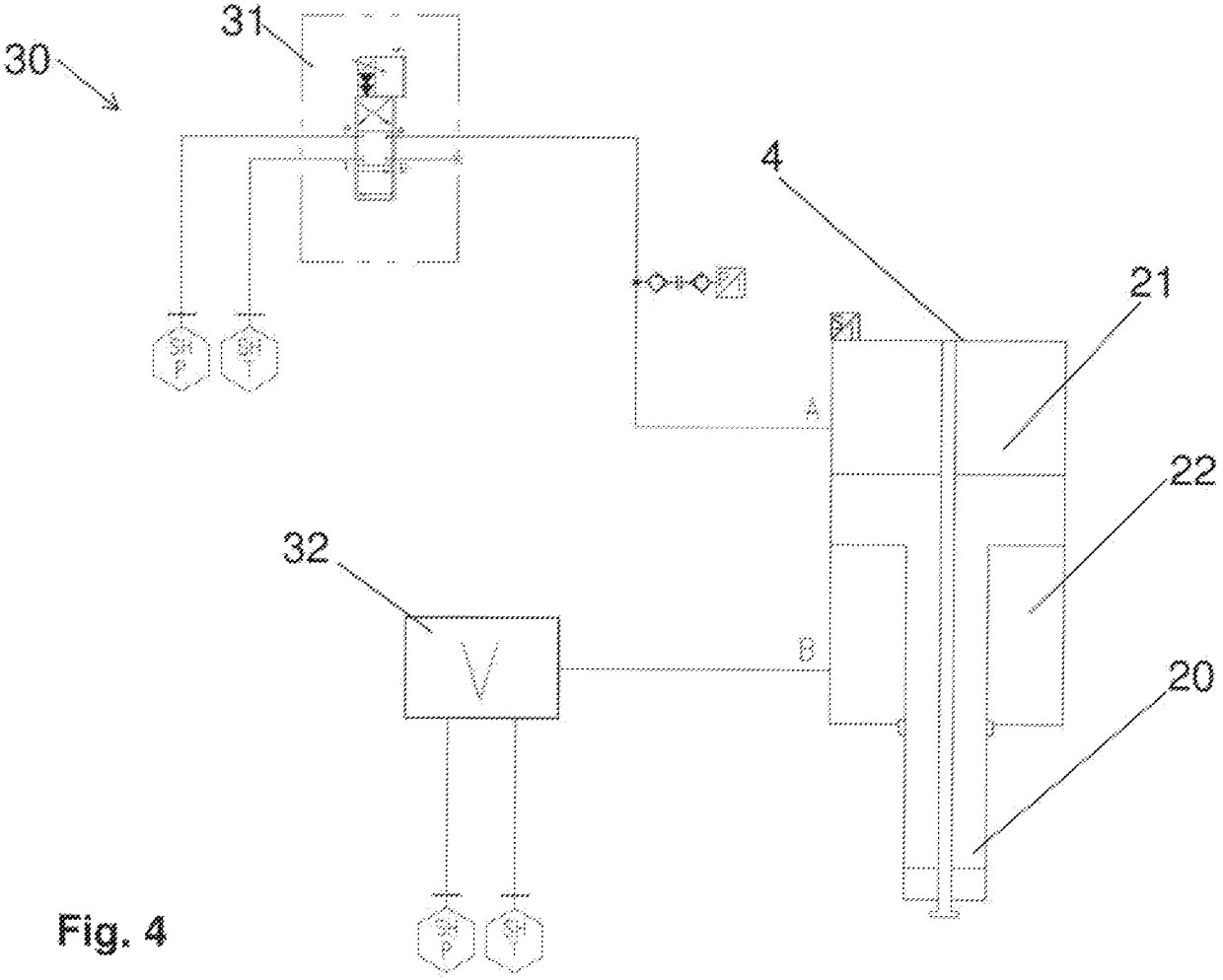
FIG. 4 shows a control diagram of the hydraulic capsule in FIG. 3 using the three-way servo valve of the prior art.
Figure 5:
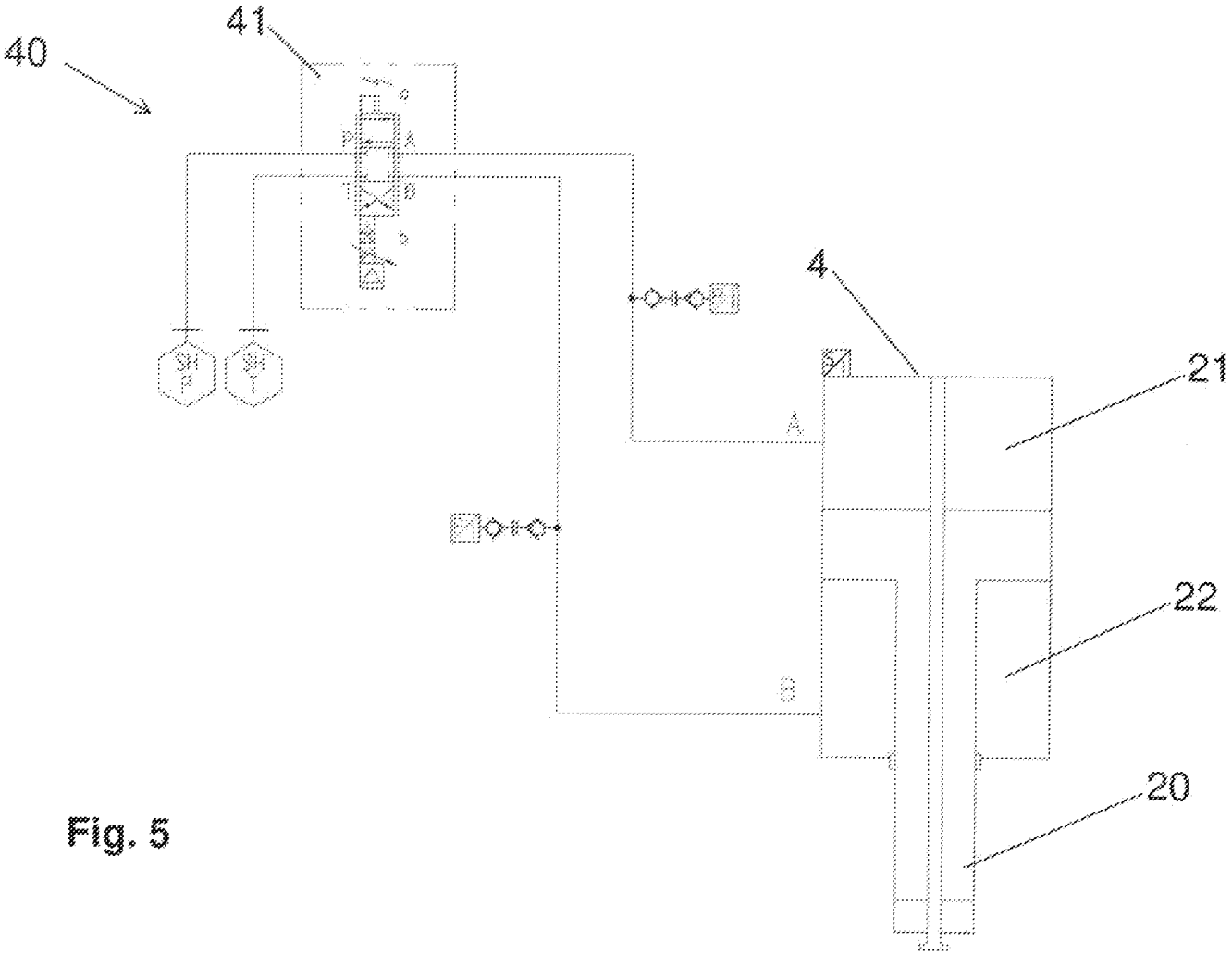
FIG. 5 shows a control diagram of the hydraulic capsule of FIG. 3 using a :four-way servo valve.
Figure 6:
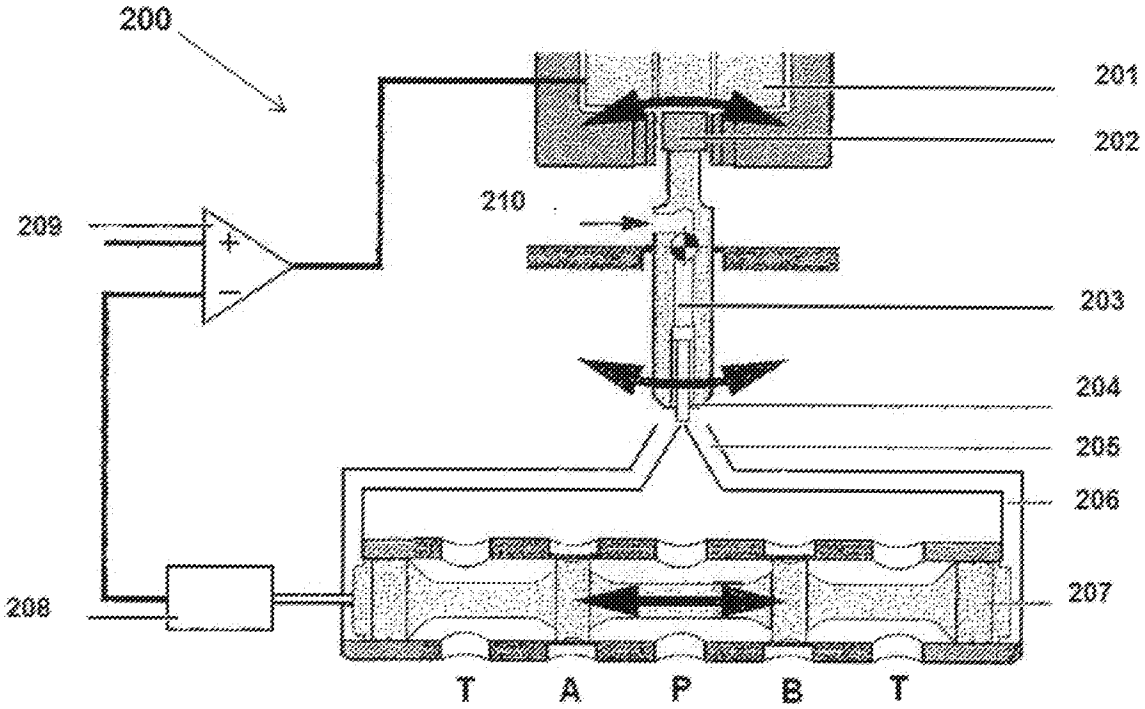
FIG. 6 shows a two-stage four-way servo valve diagram.
Figure 7:
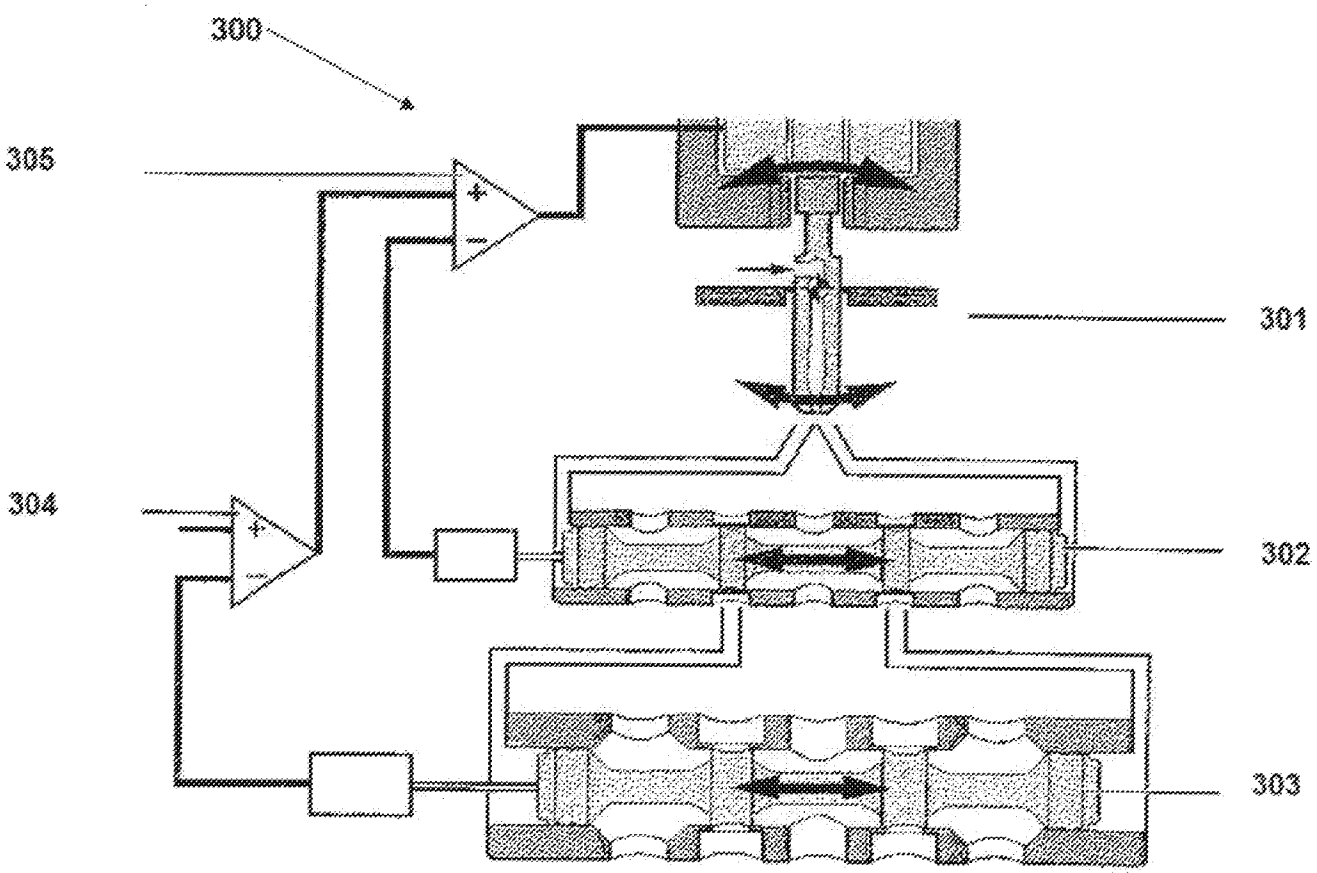
FIG. 7 shows a three-stage four-way servo valve diagram.

FIG. 1 shows a rolling mill stand 100 of a multiple stand rolling milling, each stand comprising, in this embodiment, three motorized working rollers 2 arranged in a roller holder cartridge 3. In each rolling mill stand 100, a hydraulic capsule 4', 4" is provided for each roller or working roller 2 to regulate the radial position of the roller 2 with respect to the rolling axis of the rolling mill. Advantageously, the hydraulic capsules are all with piston having a limited working stroke, and are rigidly fixed to the outer structure of the rolling mill on which the reactions forces are relieved. In each rolling mill stand 100, a hydraulic capsule 4' is arranged horizontally, while the other two hydraulic capsules 4" are appropriately slanted with respect to the vertical axis, preferably by an angle of +/−30°, and shaped so as to provide an opening of the piston such as to allow the extraction of the roller holder cartridge 3 in horizontal direction (according to axis S) from the side opposite to the horizontally arranged hydraulic capsule 4'. The hydraulic capsules 4" have a stroke which comprises, in turn, a working stroke for regulating the radial position of the roller and a distancing stroke from the piston of the rolling axis to allow to change the rollers by extracting the roller holder cartridge 3 from the side with respect to the rolling stand. It is apparent that the horizontal capsule may be identical to capsule 4" without departing from the teaching of the invention, and without compromising system operation. FIG. 2 and FIG. 3 show one of the three hydraulic capsules of a stand in any all open and closed positions. The position of the piston 20 of the hydraulic capsules 4 is controlled by a control system with electronic feedback servo valves. Such a system must be able to rapidly respond to sudden pressure variations which may occur during manufacturing, and specifically during the steps of leading-in and unloading of the tube from each single stand. The longitudinal rolling mills provided with hydraulic capsules are equipped, according to the prior art, with a linear position transducer, which allows to accurately know in real time the position of the piston with respect to the capsule, the signal of the transducer providing feedback to control the position of the hydraulic capsule, which control was previously based on a microprocessor and a three-way servo valve. FIG. 4 depicts a control diagram 30 of the hydraulic capsule using the three-way servo valve 31. As explained above, the prior art, based on approximately 20 years of use of capsules with stroke shorter than 150 mm, uses three-way servo valves in which pressure (P) and discharge (T) are connected only to port (A), being the latter connected to the main chamber 21 of the hydraulic capsule. Port (B) of the servo valve is plugged and the annular chamber 22 is fed by means of valve systems 32 adapted to guarantee a pressure as constant as possible in the annular chamber itself. In this diagram, the hydraulic capsule needs a valve system 32 to maintain the annular chamber 22 fed at constant pressure, normally in the 60-90 bar pressure range. Such a pressure value implies a value corresponding to the pressure in the main chamber 21 of the hydraulic capsule of approximately 30-45 bars. This pressure value, according to the manufactured tube, when taken by the stand, i.e. when the tube is led into the stand, suddenly increases to values up to 200-250 bars. The pressure increase causes a reduction of the oil volume due the compressibility of the same which must be compensated by introducing new oil into the main chamber. The oil compression automatically generates a yielding of the position of the roller, which indicatively opens by approximately 0.2-1.0 mm. Such a yielding corresponds to a thickening of the head of the product with respect to the tube body. It is worth noting that the thickening of the head has repercussions on the following stands, which are called to roll sections which have not been adequately reduced by the upstream stands. The position control system, based on the position transducer feedback, detects the position error of the piston 20 and controls the closing of the roller position by extending the piston. In order to reduce the yielding effect at capsule lead-in, it is consolidated practice to start while the tube is waiting from a more closed position of the working rollers and as soon as the system recognizes the material impact condition, e.g. by measuring the pressure increase in the main chamber by means of a pressure transducer, the control system takes the position reference, according to a specific motion law, to the position value related to the stationary rolling condition. Such a practice is commonly known to the person skilled in the art as impact compensation. The advantage of impact compensation is to approximately halve the transient lead-in times. In all cases, considering, for example, a tube which is rolled at 5 m/s of linear speed, a transient of 80 ms causes a thickened zone of 400 mm on the head of the tube. Thus it is apparent that all precautions must be adopted in the system and in the control logic to reduce the time and entity of the error during transient steps. The working stroke of the hydraulic capsules 4' and 4" must be appropriately limited in order to allow a suitable promptness of the capsule position control system itself. The quality of the regulation and specifically its capacity of rapidly responding to the position error depends both on the control loop of the regulator, normally of the PID=Proportional, Integrative, Derivative type and, as described above, on the physics of the system governed by the capsule stroke, on the size of the tubes, on the size of the servo valve, on the position of the hydraulic block connected to the capsule, on the pumping system of the hydraulic unit and on whether accumulators capable of reducing variations are present or not. It is well known that the physical system is more elastic as the stroke of the capsule increases, and that consequently the control system must have more limited PID gains to avoid oscillations and vibrations of the position of the capsule. This problem may be alleviated by replacing the three-way servo valve 31 in the control system with a four-way servo valve 41 having the diagram indicated in FIG. 5. The four-way servo valve 41, in practice, combines the functions of two three-way valves, feeding a chamber of the capsule and discharging the other, and vice versa. In these servo valves, according to the position controlled by the spool of the servo valve, pressure (P) and exhaust (T) are put into communication either with port (A) connected to the main chamber 21 or to port (B) connected to the annular chamber 22. FIG. 6 depicts a diagram of a two-stage four-way servo valve 200. In this figure, reference numerals 201 and 202 indicate the coil and the armature of a solenoid. In this diagram, the electronic control system 209 works on an actuator which uses the fluid of the hydraulic system 210 to drive the main valve. Again in FIG. 6, 203 indicates the jet conduit and 204 indicates the nozzle, 205 indicates the lines taking the jet to the control ports 206 for controlling the spool 207, and finally 208 indicates the pressure transducer which measures the position of the spool 207 and sends the signal to the position control loop 209. An electric current by means of the coil 201 moves the armature 202 from its neutral position, thus moving the nozzle of the conduit 203 and directing a fluid flow towards a side of the hydraulic circuit 205, thus creating a pressure difference in the port 206 and moving the spool 207, the position of which is measured by the position traducer 208. FIG. 7 depicts a diagram of a three-stage four-way servo valve 300. The pilot stage 301 moves the spool 302 of the pilot servo valve, the position of which is controlled by the control loop 305, which in turn moves the spool 303 of the main servo valve, the position of which is controlled by the control loop 304. This type of two or more stage servo valve is indeed necessary in large sized servo valves which operate in high pressure systems. By using a four-way servo valve during the tube waiting steps, the balance condition which is established between the two chambers of the hydraulic capsule will be very different from that described for the three-way servo valve because the pressure in the main chamber will be higher than 100 bars while that in the annular chamber will be higher than 220 bars. When the tube is taken, the oil is already pressurized in the main chamber and in all cases a movement of the piston in the direction in the sense of yielding, i.e. of the opening of the rollers, will cause an instantaneous decrease of the pressure in the annular chamber, which is intrinsically favorable to system stability and to position error recovery. The design of the servo valve gaps, in combination with the design of the spool, may guarantee different dynamic performances to the servo valve, without compromising the fact that by using a four-way servo valve, in all cases, the control is more reactive than that which would be obtained using a three-way servo valve with equivalent design. It is possible to continue applying the same capsule control methods with this system but with a considerably more dynamic system capable of reacting rapidly and accurately to dynamic alterations coming from the rollers themselves which may be either force or position variations. It is apparent to a person skilled in the art that without departing from the scope of protection of the invention the use of a four-way servo valve is advantageous in all cases in which the capsule stroke is increased or the specific application requires increased dynamics, thus also in the case of stand with axial working roller change.

What is claimed is:

1. A rolling mill stand defining a rolling axis, comprising a fixed outer structure, a roller holder cartridge, three or more working rollers arranged in the roller holder cartridge, the roller holder cartridge being mobile between a working position inside the fixed outer structure, at said rolling axis, and a side extraction position outside the fixed outer structure, specifically for changing the working rollers, wherein at least one respective hydraulic capsule is provided for each working roller, the capsule being rigidly fixed to the fixed outer structure to regulate the radial position of the respective working roller, having a distancing stroke from the rolling axis sufficient to allow the side extraction of said roller holder cartridge, further comprising a hydraulic system with a pressure and an exhaust circuit and a position control system of the three or more working rollers and of the at least one hydraulic capsule, each capsule having a main chamber and an annular chamber, characterized in that the position control system of said at least one hydraulic capsule comprises at least one servo valve of the four-way type and having two or more stages, the servo valve having a pressure port and an exhaust port, wherein the hydraulic connection between the servo valve and the corresponding capsule is such that the pressure port and exhaust port are disposable in fluid communication with respective ones of the main chamber and the annular chamber to effectuate prescribed positional adjustment of a corresponding one of the working rollers in a radial direction relative to the rolling axis.

2. A rolling mill stand according to claim 1, wherein the position of the hydraulic capsules is controlled by said at least one servo valve according to the feedback from the signal of a position transducer which measures the position of a spool of said at least one servo valve and sends a signal to a position control loop.

3. A rolling mill stand, according to claim 2, wherein the position controlled by the spool puts pressure and exhaust into communication either with a port connected to the main chamber or with a port connected to the annular chamber of the hydraulic capsules.

* * * * *